United States Patent [19]

Murase

[11] Patent Number: 4,532,913

[45] Date of Patent: Aug. 6, 1985

[54] COMBUSTION MEANS FOR SOLID FUEL OF LOW ASH CONTENT

[76] Inventor: Daihachiro Murase, 11-12 Mitsukeyama 1-chome, Ibaraki-shi, Osaka-fu, Japan

[21] Appl. No.: 549,544

[22] Filed: Nov. 7, 1983

[51] Int. Cl.[3] ..... F24C 1/00

[52] U.S. Cl. ..... 126/58; 126/146; 126/77

[58] Field of Search ..... 126/25 B, 25 R, 58, 126/59, 146, 9 R, 9 B, 77, 65

[56] References Cited

U.S. PATENT DOCUMENTS

| | | | |
|---|---|---|---|
| 1,919,407 | 7/1933 | Wood | 126/9 B |
| 3,413,935 | 12/1968 | Behrns | 126/25 B |
| 3,865,052 | 2/1975 | Streets et al. | 126/25 B |

FOREIGN PATENT DOCUMENTS

| | | |
|---|---|---|
| 14-36174 | 12/1939 | Japan . |
| 14-36175 | 12/1939 | Japan . |
| 15-23003 | 8/1940 | Japan . |

*Primary Examiner*—Carroll B. Dority, Jr.
*Attorney, Agent, or Firm*—Wenderoth, Lind & Ponack

[57] ABSTRACT

A combustion device for solid fuel of low ash content, which has a holding board for holding the solid fuel of low ash content which has no grooves or slits, a cylindrical body forming a combustion chamber mounted on the holding board and/or a holding cone, an air absorbing space being formed between the lower edge of the cylindrical body and the holding board, and the ignition being effected by an ignition means.

15 Claims, 22 Drawing Figures

COMBUSTION MEANS FOR SOLID FUEL OF LOW ASH CONTENT

The present invention relates to combustion means for solid fuel of low ash content. More particularly, the invention relates to combustion means for solid fuel of low ash content which can burn the solid fuel of low ash content with ease and high efficiency.

BACKGROUND OF THE INVENTION

In the conventional combustion means for a solid fuel, there is provided, in the combustion chamber, a roaster comprising a plane board in the center of which a number of air slits are formed at a fixed position. In case of burning the solid fuel, the solid fuel is piled up in a fixed height on the roaster and the piled fuel is ignited by an appropriate igniting means and is continuously burnt (cf. Japanese Utility Model Publication Nos. 36174/1964, 36175/1974 and 23003/1975). In this burning process, the solid fuel to be used is required to have fire-durability for a long time for the purpose of its use. On burning, when the solid fuel having an ash content of not more than 10% is used, it falls down from the space of the roaster, which results in lowering of heat efficiency. For preventing this drawback, when the solid fuel having an ash content of not less than 10% is used, it remains as the ash having an original shape of the solid fuel even after burning, without falling down from the roaster so that the heat efficiency can be kept for a long time. In this case, however, the amount of the ash which has remained after burning is increased and requires much effort for removing it, and further the selection of the starting material for the fuel and the molding of the same cause higher cost. For overcoming the above drawbacks, the use of solid fuel having low ash content has been proposed, whereby there is little fear of contaminating the air and the problem relating to the removal of the remaining ash in the combustion apparatus can be solved.

SUMMARY OF THE INVENTION

The primary object of the present invention is to provide combustion means for solid fuel of low ash content which make it possible to enhance the efficiency in the use of the solid fuel having low ash content, to prevent the fire from going out unintentionally and to lessen the remaining amount of unburnt substances. For achieving the above object, in the present invention, the solid fuel is held on a plane board having no air slits. On the plane board is provided a cylindrical body which constitutes a combustion chamber and surrounds the solid fuel. Between the lower edge of said cylindrical body and the plane board there is formed a small air-intake space which has a width in proportion to the amount of exhaust air. On the plane board, there is provided a holding cone which has a form which gradually narrows to the upper central portion thereof, by which the solid fuel is held in a shape of an arch.

In such construction as described, in the combustion chamber, even when the solid fuel burns at high burning temperatures to produce cracks or scattering, the solid fuel which has become minute can be held by the holding cone and the plane board without falling therefrom and without causing the lowering of the solid fuel in the central portion at high temperatures. Thus the solid fuel can continue to burn with an appropriate amount of air which is naturally drawn in through the air-intake space, along the inclined surface of the holding cone which remains warm, whereby the solid fuel burns almost completely to prevent the fire from going, which is caused by falling down of the minute solid fuel or by the falling solid fuel itself.

BRIEF EXPLANATION OF DRAWINGS

FIG. 5(*b*) is an enlarged vertical sectional view of FIG. 5(*a*);

FIG. 8(*b*) is a central vertical sectional view of the igniting means in operation showing another embodiment;

DESCRIPTION OF THE PREFERRED EMBODIMENT

Figure 1:
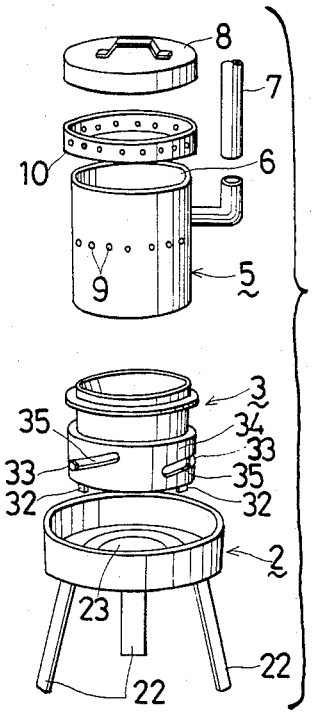
FIG. 1 is an exploded, perspective view showing one embodiment of the combustion means according to the present invention.

The present invention relates to combustion means for solid fuel of low ash content, which can assure that the solid fuel burns with ease and high efficiency.

As fuel for various uses there are employed coal, petroleum, natural gas, etc., each of which has strong and weak points. For example, coal has such strong points that, since it is solid itself, no special vessel is required for its transportation or storage and it is easily handled. On the other hand, coal has such weak points that, since it has low space-occupying rate, a large space is required when it is transported or stored, a large amount of ash is produced in the combustion, dust mixed into the exhaust gas causes air pollution, and the removal of ashes remaining in the combustion apparatus is difficult. Further, another weak point is that, since coal is solid and has few volatile components, it takes long time to ignite the fuel, and when the amount of coal to be supplied into the combustion apparatus or of the kindling fuel therein is too little, the fire disadvantageously goes out.

Petroleum and natural gases have such strong points that the amount of the ashes produced in the combustion is little and hardly any dust is mixed into the exhaust gas so that there are hardly any fears of contaminating the air. In addition, since petroleum and natural gases contain many volatile components, igniting thereof is quite easy and the amount thereof to be supplied into the combustion component may be decreased. On the other hand, since they are in the form of liquid or gas, special containers are required for their transportation or storage. Further, since they have low igniting points, they are required to be carefully handled so as not to cause accidents such as fire, explosion, etc.

As to the cost, petroleum and natural gases are more expensive than solid fuel such as coal and coke. Accordingly at present condition they are very expensive for various factories, green houses, etc. for winter heating in a cold district, wherein a large amount of fuel is consumed. Under these circumstances, having an eye on solid fuel which is easily handled during the transportation and storage, can be easily ignited and cause hardly fears of fire and explosion, there have been widely used oval briquettes, coal, and the like.

In the conventional combustion means for such solid fuel, there is provided, in the combustion chamber, a roaster which comprises a plane board and a plurality of air slits in the central portion thereof. On the roaster, the solid fuel is piled up to a predetermined height, and in this condition the solid fuel is ignited by an appropriate igniting means and thereafter is continuously burnt (cf. Japanese Utility Model Publication Nos. 36175/1964, 36174/1964 and 23003/1965). The solid fuel to be used is required to have high fire durability for the purpose of its use. On burning, when the solid fuel having an ash content of not more than 10% is used, it falls down from the space of the roaster, which results in lowering of heat efficiency. For preventing this, when solid fuel having an ash content of not less than 10% is used, it remains as the ashes having an original shape of the solid fuel even after burning out, without falling down from the roaster so that the heat efficiency can be kept for a long time. In this case however, the amount of ashes which remain after burning increases and requires much trouble for removing it, and further the selection of the starting materials for the fuel and the molding of the same cause a higher cost.

For overcoming the above drawbacks, the use of the solid fuel having low ash content has been proposed, whereby there is little fear of contaminating the air and the problem relating to the removal of the remaining ashes from the combustion apparatus can be solved.

As a conventionally used solid fuel of low ash content, there are known charcoal, lignite, coal pitch coke, petroleum coke, carsina coke, and the like, all of which are cheap and of high calorie value. These solid fuels of low ash content, however, have high sulfur contents and unfavorably influence metals during combustion. Therefore, when these solid fuels are used for industry, it is required to use them, for example, with coal or to use them in a kiln for the calcination of cement. When these solid fuels of low ash content are used as fuel for heating, they give out a bad smell and are apt to fall down because of their low ash content, which is not seen in a solid fuel having 10% or more of low ash content. When the solid fuel has 8% of ash content, it can not maintain a solid form and falls down from a roaster after burning, and the burning a high temperatures produces cracks in the fuel, which causes an increase in surface areas thereof to further increase the burning rate. During this burning, the minute, burning fuel falls down through air slits of the roaster, and the burning temperature falls due to radiant heat which stops the burning, which wastefully produces unburnt residues of the fuel. As a result, the burning efficiency of the solid fuel falls, the amount of the solid fuel accumulated during the combustion decreases unexpectedly to the fire to go out, or there occurs an additional trouble that the minute pieces of fuel falling down through the air slits of the roaster are required to be removed during the combustion. Further, since the coke is watered in the process of the production, when it is insufficiently dried, the water remaining therein becomes steam due to heating to cause scattering of the fuel and falling down of the fuel from the roaster more often than ever.

For overcoming the above drawbacks, the primary object of the present invention is to enhance the utilization efficiency of the solid fuel of low ash content, to prevent the occurrence of the unexpected going out of the fire and to decrease the amount of unburnt fuel. For achieving this object, the present invention provides a combustion means which comprises a plane board having no air slits, on which the solid fuel is held, a cylindrical body which is mounted on the plane board to surround the solid fuel and form a combustion room, a narrow air-intake space which is provided between the lower edge of said cylindrical body and said plane board and has a size in proportion to the amount of exhaust gas, and a holding cone which is provided on the plane board and has a shape which gradually narrows to the central upper tip portion so as to hold the fuel in a shape of an arch.

Accordingly, even when the solid fuel is burnt to bring about the high burning temperature so as to cause cracks or scattering of the fuel, the solid fuel which has been made minute can be held by the holding cone and the plane board without causing the lowering of the central portion of the accumulated fuel due to high temperatures and without falling down from the board. Thus the solid fuel can continue to burn with an appropriate amount of air which is naturally drawn in through the narrow air-intake space along the inclined surface of the holding cone which is kept warm, whereby the solid fuel is completely burnt to prevent the fire from going out in the middle of combustion, which is caused by falling down of the minute pieces of fuel, and to avoid the wastage caused by going out of the falling fuel itself.

In the combustion means of the present invention, as the solid fuel of low ash content, there may be used a fuel having an ash content of about 5% or less. Among the solid fuel as conventionally used, smokeless coal has an ash content of about 10% an coal coke has an ash content of about 10 to 14%, both of which cause difficulty in the disposal of abandoning ashes. As conventional fuel, for example, ogalite and lignite have ash contents of 5% or less and petroleum coke has an ash content or 1% or less. Accordingly the cheaper fuel such as lignite, petroleum coke, coal pitch coke, formed coke, briquette, carsina coke, charcoal, etc. may be used so as to overcome the difficulty in the disposal of ashes.

The present invention will be explained in detail in reference to the accompanying drawings showing the preferred embodiments.

Figure 2:
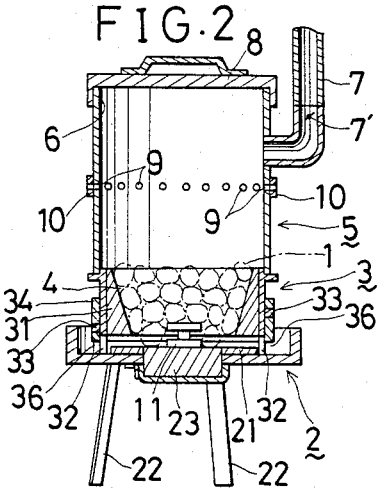
FIG. 2 is a vertical sectional view of the same.

In FIG. 1 which is an exploded perspective view of one embodiment of the combustion means for the solid fuel of low ash content according to the present invention, and in FIG. 2 which is a vertical sectional view of the same, the combustion means comprises a holding board (2) which holds the solid fuel of low ash content (1), a cylindrical body (3) which is mounted on the holding board (2) and surrounds the solid fuel (1) to form a combustion chamber (4), a drum portion (5) which is provided in connection with the cylindrical body (3) on its upper end portion, an inlet (6) for supplying the solid fuel which is provided on the upper end of the drum portion (5) and a chimney (7) which is provided on the wall of the drum portion (5) near the upper end thereof. On the chimney there may be provided a damper (7') for appropriately regulating the amount of exhaust gas. The cylindrical body (3) may have a cross-section of various shapes such as circular, octagonal, hexagonal, pentagonal, square or triangular shape in accordance with the requirements of the position in which it is to be provided or the demand of the design.

The holding board (2) comprises mainly a metal-material plane board having a predetermined thickness. On the upper surface of the board (2) there is formed a heat-insulating layer (21) by applying thereon an insulating material (e.g. castable, heat insulating bricks) having a fixed thickness. On the circumferential edge portion of the lower surface of the board (2), legs (22) having a fixed length are provided. In the center of the board (2) there is provided a shutter (23) through which the solid fuel is dropped.

The cylindrical body (3) mainly comprises a metal cylindrical case (3) having a fixed thickness. On the inner wall of the cylindrical body (3) there is formed a heat-insulating and heat-keeping layer (31) made of a fire-proof material which is strong and has good heat-insulating and heat-keeping properties. The inner surface of the layer (31) is a tapered surface which gradually narrows downward. On the lower edge of the metal cylindrical case are provided legs (32) having a fixed length. On the outer peripheral surface of the metal cylindrical case near the lower end are projecting pins (33). In fixed positions in the cylindrical case (34) which is set on the lower end portion of the metal cylindrical case (3), there are inclined grooves (35) in which the pins (33) are engaged, whereby when the cylindrical case (34) is rotated it will rise and descend. Thereby the width of the air intake space (36) which is formed between the lower edge of the cylindrical case (34) and the upper surface of the holding board (2) can be regulated.

When the cylindrical case is square, it can be raised and lowered by up and down movement by conventional means.

In FIGS. 1 and 2, the numeral (8) designates a cover closing the inlet for supplying the solid fuel, (9) designates holes for supplying air directly into the drum (5) for the purpose of controlling the combustion and (10) designates a ring for closing the holes (9).

The operation of the combustion means for the solid fuel of low ash content as constructed as above is as follows.

In the preferred embodiment of the present invention as described above, wherein no igniting means is provided, it is first necessary to put an igniting material (11) onto the holding board and to ignite the same. As the igniting material, there may be used conventional ones, for example, pieces of fire wood which are heaped up in different directions to each other, compressed paper in the shape of a rod which has been immersed in oil. For the combustion, after confirming that the igniting material (11) has been lighted, the fixed amount of the solid fuel of low ash content (1) is supplied through the inlet for supplying the solid fuel (6). The solid fuel is held on the holding board in the combustion chamber so that the solid fuel covers the igniting material (11), wherein each piece of the solid fuel is accumulated while keeping a space between it and other pieces of fuel owing to its massive shape so that the ventilation is sufficiently effected.

Thereafter, in accordance with combustion of the igniting material (11) the heating temperature of the solid fuel rises and thereby the volatile component comes out of the solid fuel due to heat decomposition and burns in the air, while the atmospheric temperature in the combustion chamber rises to reach a fixed temperature. Then the solid fuel reaches the ignition point in contact with oxygen in the air and begins to burn. At the beginning of the combustion, the whole, accumulated solid fuel becomes red with heat to bring about the combustion at high temperatures by radiant heat, and when the solid fuel becomes minute pieces due to the production of cracks thereon the minute pieces of solid fuel scatter. In this case, as the solid fuel is held on the holding board (2) having no air slits, even the minute pieces of solid fuel never fall down therefrom and can be retained in the combustion chamber at high temperatures. Thus, the solid fuel continues to burn by radiant heat and the heat-keeping effect, which are due to the structure of the cylindrical body (3), and receipt of air from the circumference. In accordance with the combustion of the solid fuel of low ash content, exhaust gas produced by combustion is issued through the chimney (7), while air is induced into the combustion chamber (4) through the air-intake space (36).

It has been confirmed, by experiment, that the size of the air-intake space (36) has a great influence on the combustion of the solid fuel of low ash content. Accordingly by setting up a suitable balance in the intake and exhaust of air, the solid fuel can actively be burnt even when it is not accumulated thickly. Therefore no provision of a special ventilator is required. When the size of the air-intake space (36) is too large, a large amount of cold air flows into the combustion chamber (4), and thereby the rate of heat-scattering becomes larger than that of heat generation to lower the atmospheric temperature in the combustion chamber (4), which results in the fire in the solid fuel going out. On the other hand, when the size of the air-intake space (36) is too small, the amount of air flowing into the combustion chamber (4) is reduced too much, there is a fear that the solid fuel of low ash content (1) goes out during combustion or backfire occurs accidentally.

In the continuation of combustion, the amount of the solid fuel of low ash content is gradually reduced. When the amount thereof reaches the limit at which the combustion can be continued, additional solid fuel of low ash content (1) is supplied through the inlet (6) so as to further continue the combustion. The addition of the solid fuel may be effected by hand or a machine. The discontinuation of combustion which is caused by failing to add solid fuel (1) can be surely prevented by provision of a temperature-sensing element which detects the temperature of the exhaust gas passing through the chimney (7), and further an apparatus for supplying a fixed amount of the solid fuel (1) when the temperature of the exhaust gas detected by the temperature-sensing element becomes lower than a predetermined temperature.

When the discontinuance of combustion is necessary, there is provided what is called a charcoal extinguisher (not shown) which is air-tight and made of a heat-insulating material. When necessry, the solid fuel (1) in the combustion chamber (4) is dropped into the extinguisher by opening a shutter (23). When the extinguisher is filled with the fuel, the shutter (23) is closed and the extinguisher is taken out. Alternatively the cylindrical case (34) is lowered in order to close the air-intake space (36) and the ring 10 is rotated to open the holes (9).

As seen from the above embodiment of the invention, even when solid fuel of low ash content produces cracks thereon and becomes minute pieces, it can be held on the holding board without falling down from the board. In addition, as the air flows through the air-intake space which is provided in the lower external periphery of the combustion chamber, the minute pieces of solid fuel are completely burnt together with the solid fuel in a shape of a mass, so that almost all of the solid fuel supplied in the combustion chamber can be burnt.

In case of using petroleum coke having an ash content of 0.2%, when 500 g of petroleum coke is supplied into the combustion chamber at first, the amount of petroleum coke which remains unburnt on the holding board (2) is about 10%. As the remaining coke can be repeatedly used in combustion, when 500 g of petroleum coke is supplied several times so as to continue the combustion, the amount of the petroleum coke remaining unburnt on the holding board (2) is always about 10 g, no change being seen in the amount of the fuel remaining unburnt. In this case hardly any ashes are produced.

Figure 4:
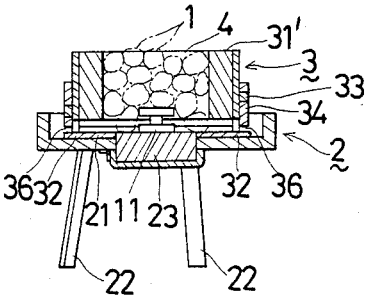
FIG. 4 is a vertical sectional view of the essential part of the combustion means showing another embodiment.
Figure 3:
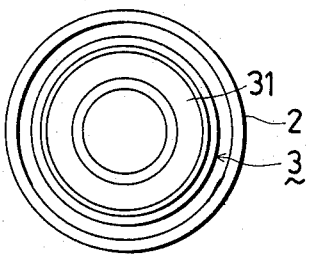
FIG. 3 is a plane view showing the essential parts of the same.

FIGS. 3 and 4 show another embodiment of the combustion means according to the present invention. FIG. 3 shows an enlarged plan view of the floor of the furnace and FIG. 4 shows a vertical sectional view of the essential portion of the combustion means according to the present invention. The difference of the embodiment in FIGS. 3 and 4 from that of FIGS. 1 and 2 is in the shape of the heat-insulating and heat-keeping layer (31') which is formed on the inner surface of the cylindrical body (3). As seen from FIGS. 3 and 4, the heat-insulating and heat-keeping layer (31') has an upper surface which is vertical and cylindrical, whereby the combustion chamber (4) has a cross-sectional area which is equal from the upper portion to the lower portion. In FIGS. 3 and 4 the other construction is the same as that of FIGS. 1 and 2 showing the first embodiment, and therefore the explanation thereof is omitted. Accordingly the function and effect in the embodiment of FIGS. 3 and 4 are the same as those in the first embodiment except that, in the practical use of the combustion means, since the width of the combustion chamber (4) is large at the lower portion thereof, the amount of the solid fuel of low ash content (1) supplied is to be increased, in order to attain the height of the accumulated fuel equal to that in the first embodiment.

Figure 5A:
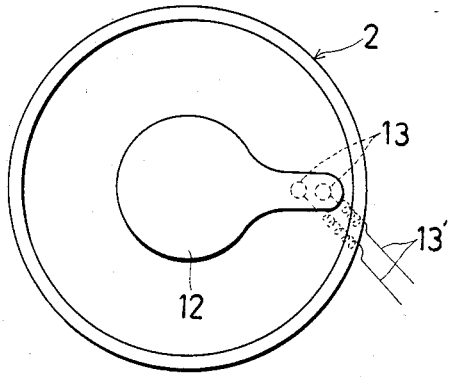
FIG. 5(*a*) is an enlarged plan view of the essential part of the igniting means showing another embodiment.
Figure 5B:
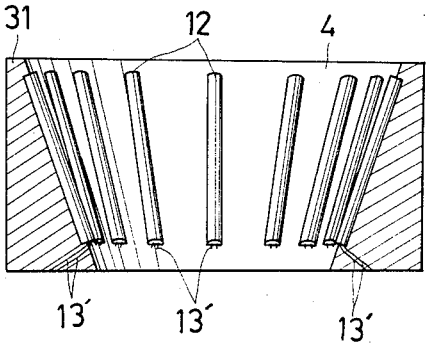
Figure 6:
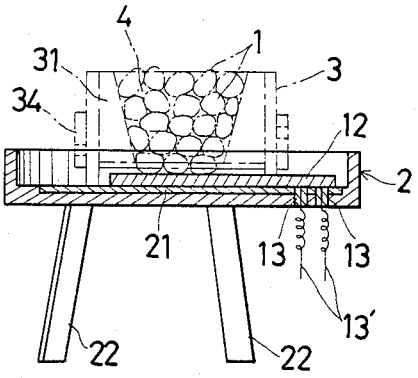
FIG. 6 is a central vertical sectional view of the igniting means in FIG. 5(*a*) in operation.

FIGS. 5*a*, 5*b* and 6 show another embodiment, wherein the difference from the first embodiment is the provision of integral igniting means (12) on the holding board (2). FIG. 5*a* is a plan view of the holding board (2) and FIG. 6 is a vertical sectional view of the combustion means showing this embodiment.

The igniting means (12), as shown in FIGS. 5*a* and 6, which has a shape of dipper or gourd and comprises a ceramic heater, is fixed on the upper surface of the holding board (2). The electrodes (13) of the ceramic heater extend to the outside of the combustion chamber (4) which is surrounded with the cylindrical body (3), thereby avoiding direct exposure to the high temperature atmosphere during the combustion of solid fuel of low ash content such as petroleum coke, etc. Alternatively, igniting means 12 in the form of a number of ceramic heaters 12 which have conventional shapes such as sheets, square or round rods, tubes, etc. are provided on the inner surface of the heat-insulating layer (31) (FIG. 5*b*) and the electrode of each ceramic heater is protected in a similar manner to that described above, whereby turning on of electric current is carried out on the outside of the combustion chamber.

The other construction in the embodiment in FIGS. 5 and 6 is the same as that of the first embodiment, the explanation thereof being omitted. In this embodiment, the combustion of the solid fuel of low ash content can be effected in a similar manner as in the first embodiment. In addition the ignition of the solid fuel can be effected easily by turning on electric currents into the ceramic heater whereby the operation can be further simplified.

Figure 7:
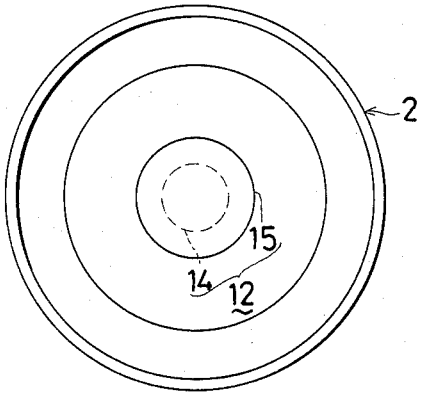
FIG. 7 is an enlarged plan view of the igniting means showing another embodiment.
Figure 8A:
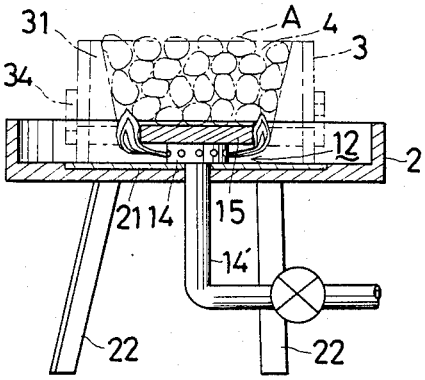
FIG. 8(*a*) is a central vertical sectional view of the igniting means in FIG. 7 in operation.
Figure 8B:
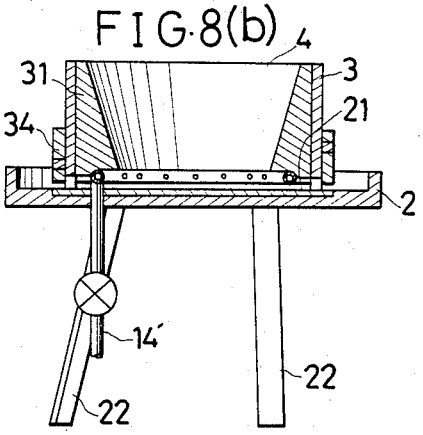

FIG. 7 is a plan view of the holding board (2) of another embodiment of the invention and FIG. 8*a* is a central, vertical sectional view of the same, wherein the difference from the embodiment of FIG. 1 is the provision of the igniting means (12) on the holding board. The igniting means shown in FIGS. 7 and 8*a* comprises a gas burner (14) which is fixed on the central upper surface of the holding board, a metal plate (15) which is loosely inserted into the lower edge of the cylindrical body (3) and is mounted on the upper surface of the gas burner (14) and a pipe (14') which extends through the holding board (2) in the vertical direction. Alternatively, the igniting means can be a gas burner as shown in FIG. 8*b*, the gas burner (14) being a pipe ring provided on the lower surface of the cylindrical body (3), and the flame comes from a group of small holes in the gas burner pipe, whereby the ignition and heating are effected directly from the bottom of the accumulated coke, without providing said metal plate. The remainder of the construction is the same as in the embodiment of FIG. 1, the explanation thereof being omitted.

In the embodiments of FIGS. 7, 8*a* and 8*b*, the combustion of the solid fuel of low ash content can be effected in the similar manner as in the first embodiment, and in addition, the ignition of the solid fuel can be easily effected simply by igniting the gas burner (14).

Further in this embodiment, the provision of the metal plate on the upper surface of the gas burner (14) is for the purpose of preventing the backfire phenomenon caused by the minute pieces of solid fuel around the gas-issuing small holes of the gas burner. If there is no fear of causing the backfire phenomenon, the metal plate (15) may be omitted. Alternatively, in the construction wherein the gas burner (14) has the shape of a ring which has a larger diameter than the opening portion of the lower end of the heat-insulating and heat-keeping layer (31) and the gas-issuing holes are provided on the inner peripheral edge thereof, the metal plate (15) can be omitted.

Figure 9:
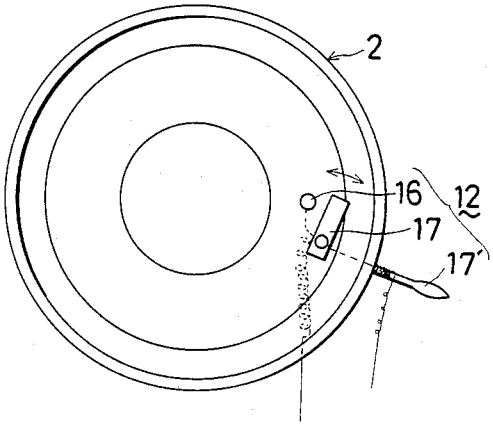
FIG. 9 is an enlarged plan view of the igniting means showing another embodiment.
Figure 10:
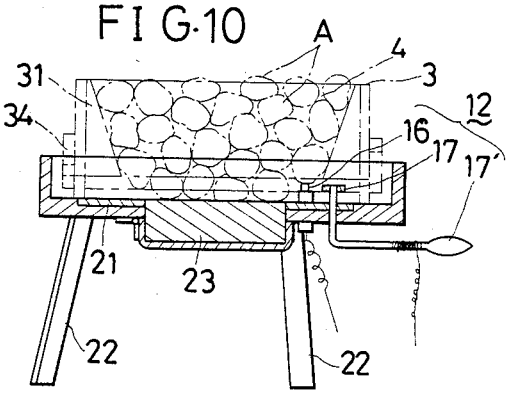
FIG. 10 is a central vertical sectional view of the igniting means in FIG. 9 in operation.

FIG. 9 is a plan view of the holding board (2) showing another embodiment and FIG. 10 is a central, vertical sectional view of the same, wherein the difference from the first embodiment is the provision of the igniting means (12) on the upper surface near the peripheral edge of the holding board (2). In the igniting means (12) in FIGS. 9 and 10, a carbon rod (16) extends through the holding board (2) near the peripheral edge, and a metal plate (17) is pivotally mounted on the board (2) for pivotal movement into and out of contact with the carbon rod (16), and a DC voltage source (not shown) is connected between the carbon rod (16) and the metal plate (17). An operating means (17') in the form of a handle is connected to the metal plate (17) to cause it to pivot and extends outside of the combustion chamber (4), and the metal plate (17) is made to pivot by hand. Alternatively it can be connected to a motor. The pivoting brings the plate (17) to a position to produce an arc between the carbon rod (16) and the metal plate (17). The remainder of the construction is the same as that of the first embodiment, the explanation thereof being omitted. In this embodiment, the combustion of the solid fuel of low ash content can be effected in a similar manner as in the first embodiment, and further the operation can be much more simplified, since the ignition of the solid fuel can be easily effected by making the metal plate (17) pivot to produce an arc.

In the above embodiment, the reason why the provision of the carbon rod (16) and the metal plate (17) is at the peripheral edge of the holding board (2) is for preventing the pivoting of the metal plate (17) to be blocked by the presence of the solid fuel (1) supplied into the combustion chamber (4). Accordingly when the pivoting of the metal plate (17) or the reciprocal movement of the metal plate relative to the carbon rod (16) can be assured, the provision of the carbon rod and the metal plate on the center of the holding board is more favorable for improving the ignition efficiency.

For the purpose of assuring the pivoting movement of the metal plate (17), for example, the carbon rod extends through the central portion of the holding board (2) and is fixed to the stand, and at the same time, at a fixed position on the upper surface of the board (2), a hollow groove is provided facing the carbon rod (16) with the metal plate (17) in the hollow groove so that it can pivot reciprocally. In such construction, if the solid fuel of low ash content (1) is larger than the width of the hollow groove, there is no fear that the solid fuel will fall into the groove. Thus, the smooth reciprocal movement of the metal plate (17) is possible and therefore the ignition of the solid fuel can be effectively effected at the central portion of the holding board where a large amount of the solid fuel is present.

Figure 11:
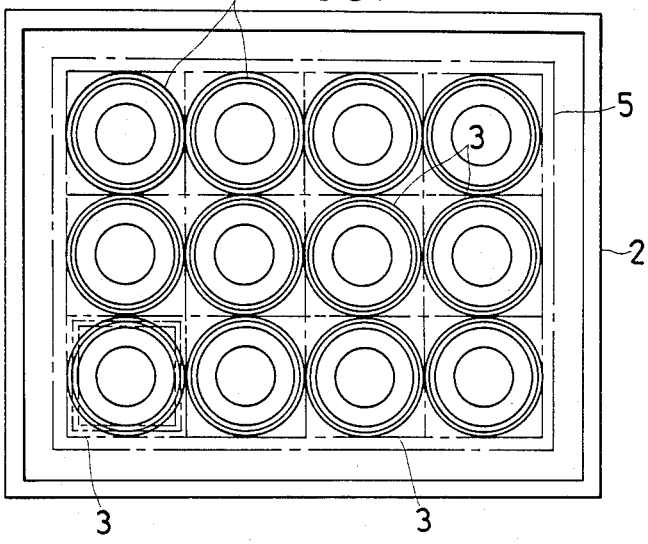
FIG. 11 is a plan view showing the arrangement in which a plurality of the combustion means of the present invention are arranged in one apparatus.
Figure 12:
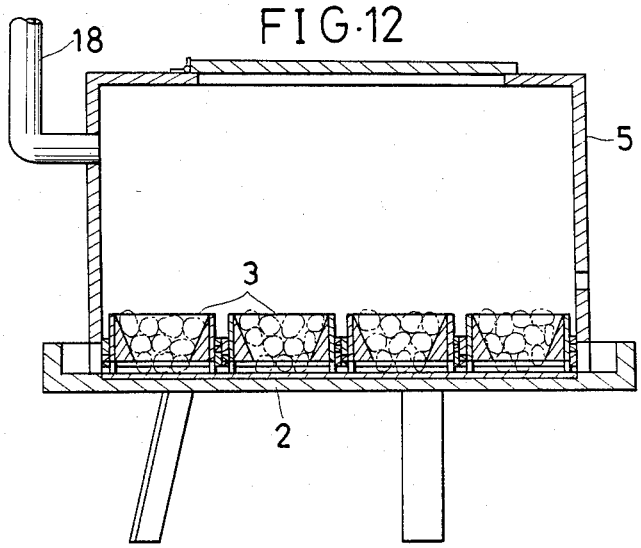
FIG. 12 is a sectional view of the apparatus in FIG. 11 which is in operation.

FIG. 11 is a plan view of the combustion means according to another embodiment, wherein a large amount of the solid fuel is simultaneously burnt, and FIG. 12 is a central, vertical sectional view of the same. In FIGS. 11 and 12, there are provided a plurality of holding boards (2) closely adjacent or in contact with each other, on each of which a cylindrical body (3) is mounted. Around all the cylindrical bodies (3), one drum portion (5) is provided. At one fixed position of the drum portion (5), a duct (18) for discharging exhaust gas is provided.

In this embodiment, the plural combustion chambers (4) constitute a single combustion chamber means, and the combustion of the solid fuel (1) can be effected in each cylindrical body simultaneously. As a result, the radiant heat generated from each cylindrical body interacts with that from the others, whereby the calorific amount from the whole combustion chamber means and the amount of exhaust gas generated can remarkably be increased.

Accordingly, for example, by supplying a large amount of exhaust gas into a drying chamber (not shown in the drawing), the materials to be dried therein can be efficiently dried.

In this case, it is preferable to use petroleum coke as the solid fuel (1). Since the petroleum coke has an ash content of 1% or less, the exhaust gas hardly contains any dust and therefore there is little fear of exerting an unfavorable influence on the material to be dried. Further the use of the solid fuel of low ash content in a thin layer can provide efficient combustion.

Figure 13:
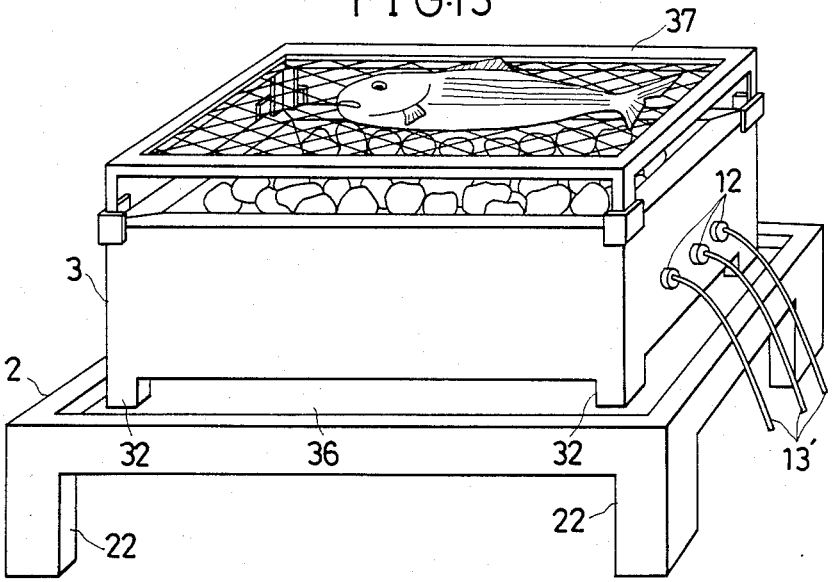
FIG. 13 is a perspective view of the combustion means showing another embodiment.
Figure 14:
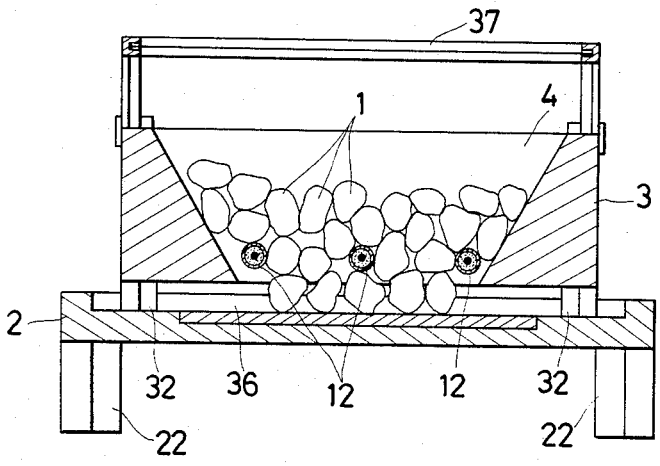
FIG. 14 is a central vertical sectional view of the combustion means in FIG. 13.

FIG. 12 is a perspective view of the combustion means of the present invention to show another embodiment and FIG. 14 is a vertical sectional view of the same, in which the difference from the first embodiment is the provision of the ignition means (12) in the lower portion of the combustion chamber (4) and a grille thereabove. The ignition means (12) shown in FIGS. 13 and 14 comprises plural ceramic heaters (12) having the shape of a tube, etc. which are positioned at the lower portion of the combustion chamber (4) and slightly above the bottom of the combustion chamber, the toasting grille (37) having legs which are mounted on the upper edge of the cylindrical body (3) and the electrode portions (13') for supplying electric power to the ceramic heaters (12) which extend out from the one side of the cylindrical body (3). In this case, the solid fuel (1) is shown as being used to broil fish placed on the toasting grille (37) which is placed on the upper portion of the cylindrical body (3). As the remaining construction is the same as that of the first embodiment, an explanation thereof is omitted. In this embodiment, the combustion can be effected in a similar manner as in the first embodiment but using the ignition means by which the ignition can be effected simply by turning on the electric power to the ceramic heater, whereby the operation of the combustion means can further be simplified and there can be provided a combustion means suitable for broiling fish, etc.

Figure 15:
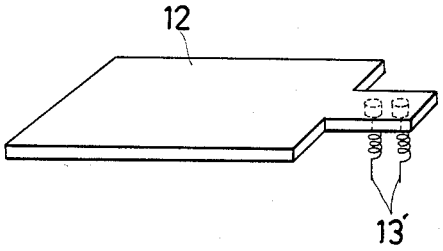
FIG. 15 is an enlarged perspective view of the igniting means showing another embodiment.
Figure 16:
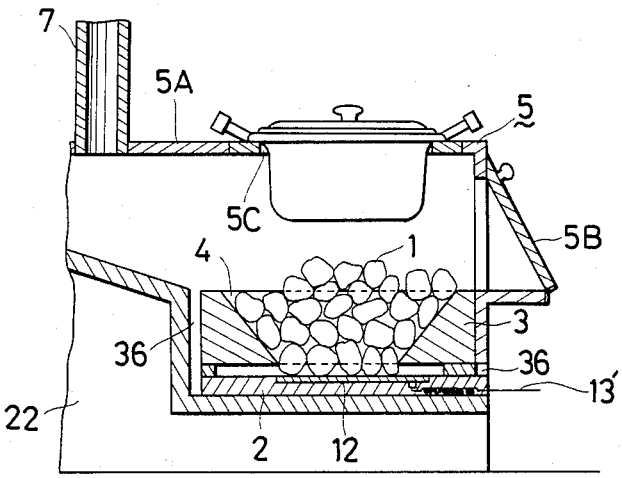
FIG. 16 is a central vertical sectional view of the igniting means in FIG. 15 in operation.

FIG. 15 is a perspective view of the ignition means (12) showing another embodiment of the invention, and FIG. 16 is a central vertical sectional view of the combustion means provided with the ignition means in FIG. 15. In FIG. 16, the combustion means comprises an oven (5) which comprises a ceiling plate (5A), an opening portion (5C) therein in which a pot, etc. is placed, and an inlet covered by a cover (5B) for supplying the solid fuel of low ash content (1). Inside the oven (5) there is a step portion on which a combustion apparatus is placed. At the upper portion of the oven (5) a chimney (7) is provided for exhausting gases. In the opening portion (5C) is placed a pot, and at the lower portion of the combustion apparatus is provided a ceramic heater (12) as the ignition means. The ignition means is provided, as shown in FIG. 15, with the electrode portion (13'). The combustion chamber (4) which is surrounded by the cylindrical body (3) has a shape which gradually narrows downward and is filled with the solid fuel of low ash content (1) which is placed on said ignition means (12). By supplying electric power to the ignition means (12) comprising the ceramic heater through the electrode portion (13'), the solid fuel of low ash content is ignited. As seen from FIG. 16, between said cylindrical body (3) and a holding board (2) in which the ignition means (12) is set is provided an air-space (36), and the inlet covered by cover (5B) for supplying solid fuel is provided on the side of the oven (5) in such a manner that it can be freely opened or closed.

Figure 17:
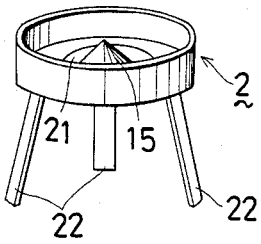
FIG. 17 is a perspective view of the essential part of the combustion means showing another embodiment.

FIG. 17 is a perspective view showing the essential part of the combustion means according to another embodiment, wherein the difference from the first embodiment is in the provision of a holding cone (15) projecting upward in the cylindrical body from the central portion of the holding board (2), the remaining construction being the same as in the first embodiment.

Figure 18:
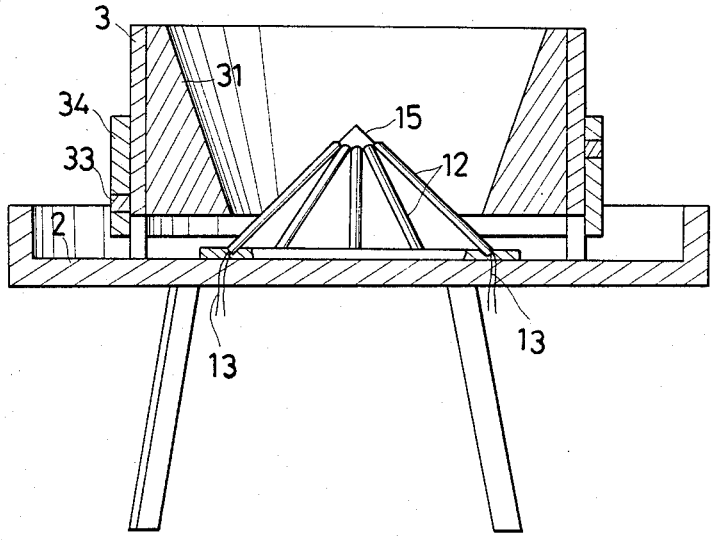
FIG. 18 is a central vertical sectional view of the essential part of the combustion means showing another embodiment.

FIG. 18 is a central vertical sectional view of the combustion means of the invention according to another embodiment, wherein the difference from the first embodiment is in the provision of the ignition means (12) on the holding cone (15) as shown in FIG. 17. In FIG. 18, each ignition means (12) is placed on the conical surface of the cone (15) projecting upward in the cylindrical body (3) from the holding board (2), and the electrode portion (13) extends out of the lower portion of the cone (15) to supply electric power. As the remaining construction is the same as in the first embodiment, the explanation thereof is omitted.

Figure 19:
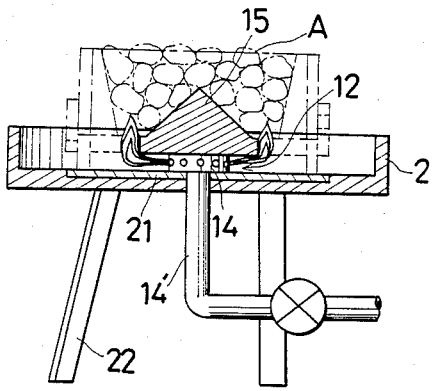
FIG. 19 is a central vertical sectional view of the combustion means showing another embodiment which is in operation.

FIG. 19 is a central vertical sectional view of the combustion means of the invention according to another embodiment, characterized in that there is provided, in the combustion chamber, a metal plate which is the same as in FIG. 8*a*, but having the shape of a cone.

Figure 20:
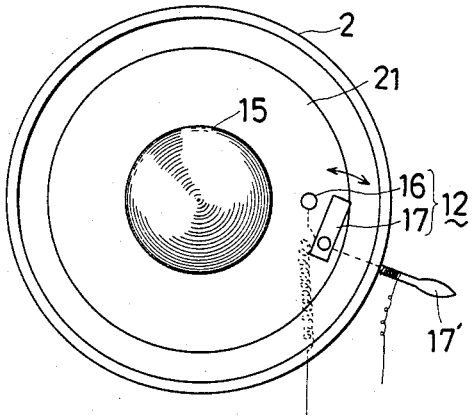
FIG. 20 is an enlarged plan view of the igniting means showing another embodiment.

FIG. 20 is a plan view of the holding board (2) according to another embodiment, wherein the difference from that of FIGS. 9 and 10 is the provision of a holding cone (15) projecting into the cylindrical body from the central portion of the holding board (2), and the remaining construction is the same as in FIGS. 9 and 10, the explanation thereof being omitted.

In the embodiments shown in FIGS. 17 and 20, the provision of the holding cone (15) can make the circulation of the air stream during combustion excellent. Further on the holding cone, the ashes slide down along the surface of the holding cone, and there does not occur the falling down of the fuel on the central portion of the holding board, which often occurs in case of the plane holding board or metal plate corresponding to the bottom of the combustion chamber, whereby the combustion efficiency can be further improved.

According to the present invention, as described above, the solid fuel of low ash content in which cracks are produced during the combustion can be held on the holding board having no air slits, directly or by the holding cone, and further there is provided the air space between the lower edge of the cylindrical body surrounding the solid fuel on the holding board and forming a combustion chamber and the holding board and/or the holding cone, and therefore the combustion can be completely effected without providing a roaster. Further there can be eliminated the trouble that the solid fuel is subjected to some treatments for avoiding the formation of fine powders or for remolding to prevent the solid fuel from scattering during combustion, as is required with the conventional solid fuel such as various kinds of cokes, and accordingly solid fuel which has not been worked up can be used in the combustion apparatus with high efficiency. Advantageously, according to the present invention, the generation of injurious gases and air pollution caused by ashes can be prevented, and low priced solid fuel can be used as it is. Furthermore, there can be avoided the trouble that a roaster having a specific shape or construction according to the object must be provided, and the cost of manufacturing such a device is avoided. In the combustion means of the present invention, the provision of the holding cone can cause the combustion air stream to smoothly rise, and the fallowing down of the solid fuel at the central portion during combustion can be prevented, while the slightly amount of ashes produced slides down the cone, whereby the combustion efficiency can remarkably be improved.

What is claimed is:

1. A combustion means for solid fuels of low ash content, comprising:

a holding board for holding solid fuels of low ash content, said board being free of grooves and slits and having, on its upper surface, a heat-insulating and heat-retaining layer made of a heat-resistant material;

a cylindrical body defining a combustion chamber therewithin, said cylindrical body being removably mounted on said holding board and mounted above said heat-insulating and heat-retaining layer on said holding board for movement toward and away from said layer and said board and spaced from said layer and said board to define an air intake space therebetween the size of which can be freely regulated by said movement of said cylindrical body;

a further heat-insulating and heat-retaining layer made of a heat-resistant material on the inside of said cylindrical body;

a drum portion on the top of said cylindrical body and having an inlet opening therein for supplying fuel to said combustion chamber and a cover removably mounted over said inlet opening; and a chimney on said drum portion for discharging gaseous products of combustion from said drum portion.

2. Combustion means as claimed in claim 1 in which said cylindrical body comprises an inside cylinder and an outside cylinder, the inside cylinder having said further heat-insulating and heat-retaining layer on the inner peripheral wall thereof and a plurality of legs on the lower end supported on said holding board, and said outside cylinder being mounted on said inside cylinder for sliding up and down along said inside cylinder for regulating the width of said air intake space.

3. Combustion means as claimed in claim 1 in which said further heat-insulating and heat-retaining layer in said cylindrical body has an inwardly and downwardly tapered inner peripheral surface.

4. Combustion means as claimed in claim 1 further comprising an imperforate holding cone on said holding board and made of a heat-resistant material and projecting upwardly into said combustion chamber and having the periphery thereof spaced from the lower inner peripheral edge of said further heat-insulating and heat-retaining layer in said cylindrical body.

5. Combustion means as claimed in claim 1 further comprising igniting means made of heat-resistant material mounted on said holding board.

6. Combustion means as claimed in claim 5 in which said igniting means is a heat-resistant plate.

7. Combustion means as claimed in claim 1 further comprising igniting means made of heat-resistant material mounted on the inner peripheral surface of said further heat-insulating and heat-retaining layer on said cylindrical body.

8. A combustion means for solid fuels of low ash content, comprising:

a holding board for holding solid fuels of low ash content, said board being free of grooves and slits and having, on its upper surface, a heat-insulating and heat-retaining layer made of a heat-resistant material;

a cylindrical body defining a combustion chamber therewithin, said cylindrical body being removably mounted on said holding board and mounted above said heat-insulating and heat-retaining layer on said holding board for movement toward and away from said layer and said board and spaced from said layer and said board to define an air intake space therebetween the size of which can be freely regulated by said movement of said cylindrical body;

a further heat-insulating and heat-retaining layer made of a heat-resistant material on the inside of sad cylindrical body;

a drum portion on the top of said cylindrical body and having an inlet opening therein for supplying fuel to said combustion chamber and a cover removably mounted over said inlet opening, said drum portion having a plurality of air holes through the wall thereof extending peripherally around the wall, and means movable on said drum portion for opening and closing said air holes; and a chimney on said drum portion for discharging gaseous products of combustion from said drum portion.

9. Combustion means as claimed in claim 1 further comprising an imperforate holding cone on said holding board and made of a heat-resistant material and projecting upwardly into said combustion chamber and having the periphery thereof spaced from the lower inner peripheral edge of said further heat-insulating and heat-retaining layer in said cylindrical body.

10. A combustion means for solid fuels of low ash content, comprising:

a holding board for holding solid fuels of low ash content, said board being free of grooves and slits and having, on its upper surface, a heat-insulating and heat-retaining layer made of a heat-resistant material;

a cylindrical body defining a combustion chamber therewithin, said cylindrical body having an inside cylinder and an outside cylinder, the inside cylinder having a further heat-insulating and heat-retaining layer on the inner peripheral wall thereof and a plurality of legs on the lower end supported on said holding board, the lower end of said inner cylinder being spaced from said layer and said board to define an air intake space therebetween, said outside cylinder being mounted on said inside cylinder for sliding up and down along said inside cylinder for regulating the width of said air intake space;

a hollow drum portion on the top of said cylindrical body and having an inlet opening therein for supplying fuel to said combustion chamber and means for controlling the amount of air flow therethrough;

a chimney on said drum portion for discharging gaseous products of combustion from said drum portion; and a solid holding cone on said holding board and said layer and made of a heat-insulating and heat-retaining material, said cone having a diameter at the lower end of said further heat-insulating and heat-retaining layer which is smaller than the inner diameter of said lower end.

11. Combustion means as claimed in claim 10 in which said cone is conical.

12. Combustion means as claimed in claim 10 in which said cone is pyramidal.

13. Combustion means as claimed in claim 10 further comprising igniting means made of heat-resistant material fixed to said holding board.

14. Combustion means as claimed in claim 13 in which said igniting means is a heat-resistant plate.

15. Combustion means as claimed in claim 10 further comprising igniting means made of heat-resistant material mounted on the inner peripheral surface of said further heat-insulating and heat-retaining layer on said cylindrical body.

* * * * *